US008261506B2

(12) United States Patent
Boucke

(10) Patent No.: US 8,261,506 B2
(45) Date of Patent: Sep. 11, 2012

(54) METHOD OF MANUFACTURING A FLOOR PANEL

(75) Inventor: Eddy Boucke, Menen (BE)

(73) Assignee: Berry Finance, N.V. (BE)

( * ) Notice: Subject to any disclaimer, the term of this patent is extended or adjusted under 35 U.S.C. 154(b) by 161 days.

(21) Appl. No.: 12/816,504

(22) Filed: Jun. 16, 2010

(65) Prior Publication Data

US 2010/0251658 A1 Oct. 7, 2010

Related U.S. Application Data

(62) Division of application No. 10/525,282, filed on Feb. 16, 2005, now Pat. No. 7,763,143.

(30) Foreign Application Priority Data

Dec. 1, 2004 (WO) ..... PCT/EP2004/013637

(51) Int. Cl.
*E04B 2/00* (2006.01)

(52) U.S. Cl. ..... 52/588.1; 52/589.1

(58) Field of Classification Search ..... 52/588.1, 52/506, 589.1, 586.1
See application file for complete search history.

(56) References Cited

U.S. PATENT DOCUMENTS

| | | | | |
|---|---|---|---|---|
| 4,008,551 | A * | 2/1977 | MacDonald et al. | 52/316 |
| 6,617,009 | B1 * | 9/2003 | Chen et al. | 428/195.1 |
| 6,675,545 | B2 * | 1/2004 | Chen et al. | 52/586.1 |
| 6,786,019 | B2 * | 9/2004 | Thiers | 52/589.1 |

* cited by examiner

*Primary Examiner* — Basil Katcheves
(74) *Attorney, Agent, or Firm* — David I. Roche; Baker & McKenzie LLP

(57) ABSTRACT

Described is a simple and inexpensive method of manufacturing a floor panel (2) with which a floor panel (2) can be produced with a beveled or recessed edge (10*a*, 10*b*, 25, 26), a top surface layer (4) extending continuously and in one piece from a top side (3*a*) of a core (3) over the beveled edge (10*a*, 10*b*, 25, 26). A panel body (12) is first of all provided with a core (3, 13), a top side (3*a*, 13*a*) of the core (3, 13) being provided with a top surface layer (4). A recess (15) is then formed from a side surface (13*b*) into the panel body (12), the recess extending under the top surface layer (4) and leaving a freestanding ledge (16) which includes the top surface layer (4). The recess (15) is then closed by fixing the first and second recess surfaces (15*a*, 15*b*) to one another.

8 Claims, 5 Drawing Sheets

METHOD OF MANUFACTURING A FLOOR PANEL

RELATED APPLICATIONS

The present application is a divisional of pending U.S. patent application Ser. No. 10/525,282 filed Feb. 16, 2005, incorporated herein by reference, which is a National Phase entry in the United States claiming priority to PCT/EP2004/013637 filed on Dec. 1, 2004.

TECHNICAL FIELD

The present invention relates to a method of manufacturing a floor panel with a beveled edge.

BACKGROUND OF THE INVENTION

Floor panels are known in very different types and designs. It is standard practice to manufacture floor panels in such a manner that when laid they form a floor covering in the case of which the upper tread side gives a closed impression if possible. However, there are also cases where it is desired that longitudinal and/or transverse sides of neighboring floor panels that abut on one another form a notch that is recessed relative to the upper tread surface. This may e.g. be of advantage when the floor panels are provided with a joining system on their longitudinal and/or transverse sides, the system requiring an angular twisting of neighboring floor panels during laying. In this instance it may be of advantage to provide more play for the twisting operation by way of a beveled edge. Moreover, it may be of advantage when e.g. in a floor covering in the style of a country house floorboard, the edges of neighboring floor panels that abut on one another are highlighted by notches.

These notches have so far been produced by cutting or grinding off the corresponding edges on the floor panel, as is usually done wherever edges are to be beveled. However, due to such a removal of the material on the edge to be beveled, the beveled edge looks different from the remaining top surface of the floor panel. For instance, when the floor panel having a core of a suitable constructional plate is made from a wood material, particularly an MDF or HDF, and from a wear-resistant decorative top surface layer, the top surface layer and most of the time also the core are partly cut during beveling of the edge, resulting in an ugly appearance differing from the rest of the floor panel. Moreover, the cut away side has a weaker product performance, e. g. is not protected anymore against moisture and dirt penetration, and has a poor wear resistance.

To avoid such a situation, it has already been suggested in WO 01/96688 that a separate decorative layer should be applied to the beveled edge. The application of such a separate layer, however, is very complicated because the means used therefor must be adjusted very accurately. Nevertheless, the transition between the tread side and the beveled edge remains visible all the time.

SUMMARY OF THE INVENTION

It is thus the object of the present invention to provide a method of manufacturing a floor panel with a beveled edge that can be carried out easily and at low costs and yields a floor panel that shows no interruption in the surface layer.

This object is achieved by the method according to claim 1 and by the floor panel according to claim 10.

In the method of the invention, a panel body is first provided with a core, the top side of the core being provided with a top surface layer. The panel body further comprises a side surface which extends in a direction transverse to the top surface layer. Subsequently, a recess is formed from the side surface into the panel body, the recess extending under the top surface layer and leaving a freestanding ledge including the top surface layer. The recess is manufactured with opposite first and second recess surfaces. Subsequently, the recess is closed in that the opposite first and second recess surfaces are fixed to one another. This provides for a floor panel having a beveled upper edge, the top surface layer extending continuously and in one piece from the top side of the core over the beveled upper edge.

The method of the invention can be carried out easily and produces a floor panel with a beveled edge having a surface corresponding exactly to the surface on the tread side of the floor panel. Thus, the surface of a floor covering made from the floor panel of the invention has the same properties and the same appearance up and into the notches formed by the beveled edges.

Advantageous developments of the invention become apparent from the subclaims.

The recess is preferably wedge-shaped because such a shape can be closed particularly easily and because with such a shape the two recess surfaces can be fixed directly to one another.

When one of the recess surfaces is arranged next to and substantially in parallel with the top surface layer, the recess can be closed particularly easily, resulting in a smooth and neat bevel.

Preferably, the first and second recess surfaces are plain because such surfaces can be produced particularly easily.

The recess is preferably closed by the application of adhesive, which is particularly recommended in the case of floor panels of wood materials.

The recess can be closed particularly easily when pressure is applied to the ledge.

Production of the floor panel, and particularly the closing of the recess, is simplified when the ledge consists substantially only of the surface layer.

When the floor panel is provided with joining elements that are formed fully or in part from the panel body, the recess can be produced in a simple way simultaneously during production of the joining elements and preferably in the same operation step.

If necessary, for instance for improving the fit of joining elements positioned on the side surface of the panel body, the side surface can be worked such that it is continuously smooth and substantially without any step after the recess has been closed.

BRIEF DESCRIPTION OF THE DRAWINGS

An embodiment of the present invention will now be explained in more detail with reference to the drawings, in which.

DETAILED DESCRIPTION OF THE PREFERRED EMBODIMENT

Figure 1:
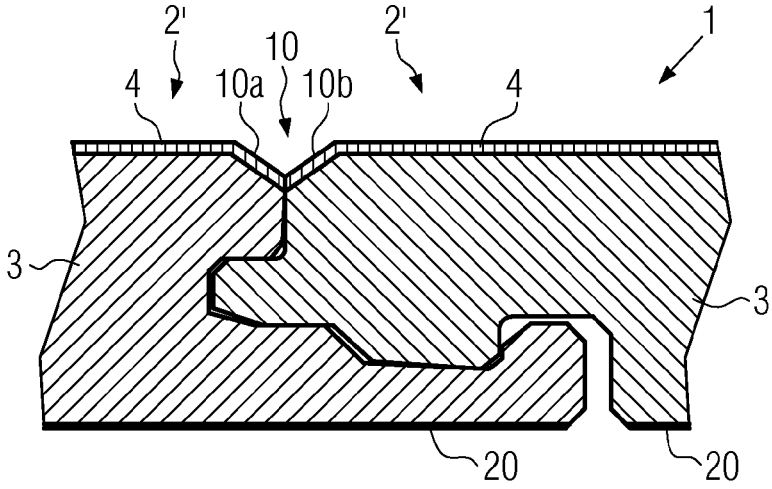
FIG. 1 is a cut illustration showing part of a floor covering consisting of floor panels according to the invention.
Figure 2:
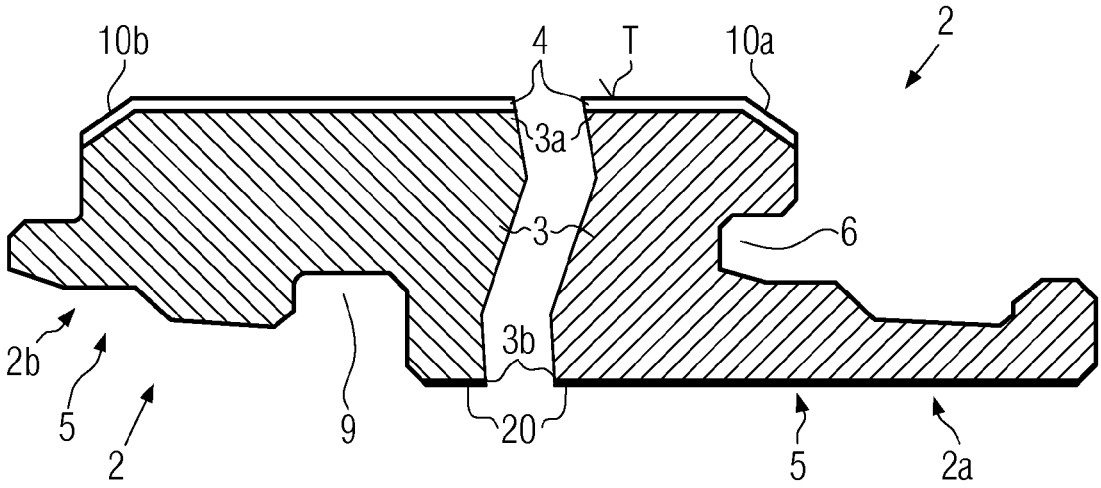
FIG. 2 is a cut illustration showing a floor panel.

FIG. 1 shows part of a floor covering 1 composed of a multitude of substantially identical floor panels 2 which are shown in more detail in FIG. 2 (FIG. 1 shows the right side of a first floor panel 2' attached to the left side of a second floor panel 2"). The floor panel 2 has a substantially rectangular shape with a first side 2*a*, an opposite side 2*b* parallel thereto, and third and fourth sides (not shown) extending at a right angle relative to the first and second sides 2*a*, 2*b*. The floor panel 2 has the standard dimensions which permit an easy and simple handling of the floor panel 2 by one person. Preferably, such floor panels have a width between 10 cm and 20 cm, a length between 1 m and 2 m and a thickness between half a centimeter and one centimeter, possibly also several centimeters. Floor panels, however, may also have a square design having sides of equal length.

For a simplified illustration the illustrated floor panel 2 is just shown to consist of a core 3 and a top surface layer 4 covering the top side 3*a* of the core 3. The bottom side 3*b* can be covered by a bottom layer 20. The core 3 preferably consists of a wood material, for instance a MDF or HDF plate. The top surface layer 4 consists of a wear-resistant decorative layer, as are normally used in floor panels for so-called laminate floors. The top surface layer 4 is fixed in the standard way to the top side 3*a* of the core 3 and forms a tread surface T.

The floor panel 2 is provided at each of the opposite sides 2*a*, 2*b* with joining elements 5 which allow for a position-fixing connection to neighboring floor panels 2'. The illustrated embodiment shows joining elements 5 which permit a laying of the floor panels 2 without any glue. The joining elements usually include a groove 6 which extends along the one side 2*a* of the floor panel 2 substantially in horizontal direction, i.e. parallel to the tread surface T, into the core 3, and a corresponding projection 7 provided along the opposite side 2*b*, which fits into the groove 6 of the neighboring floor panel 2', 2". Groove 6 and projection 7 thereby fix the position of the two floor panels 2', 2" in conjunction with the floor covering 1 in a direction perpendicular to the tread surface T. A positional fixation in the plane of the tread surface T is accomplished through a vertical projection 8 at the first side 2*a* and a corresponding vertical groove 9 at the opposite side 2*b* of the floor panel 2. Of course, differently constructed joining elements may be provided, or the floor panel 2 may be configured for a laying with the help of glue.

A notch 10 which is recessed relative to the tread surface T is formed between neighboring panels 2', 2" in the floor covering 1. The notch 10 is formed by beveled or recessed edges 10*a*, 10*b*, or simply bevels, provided on the neighboring floor panels 2', 2" and has a substantially triangular cross-section in the illustrated embodiment. Other cross-sectional shapes are also possible. To be more specific, the term "beveled edge" shall cover any design recessed relative to the tread surface T, i.e., for instance, bevels and rounded portions, or combinations thereof, as described in further detail below.

As clearly shown in FIG. 1, the surface layer 4 of panel 2' extends continuously and in one piece from the top side 3*a* of the core 3, which is adjacent to the notch 10, over the beveled edges 10*a*, 10*b* into the notch 10 and is flush with the top surface layer 4 of the neighboring floor panel 2".

How this is accomplished shall be explained in the following with reference to FIGS. 3 to 5. The method of the invention shall be described with reference to the sides 2*a* and 2*b* of the floor panel and/or, if desired, also to the other two sides (not shown in FIG. 1) of the floor panel if a notch 10 is also desired on those sides.

Figure 3:
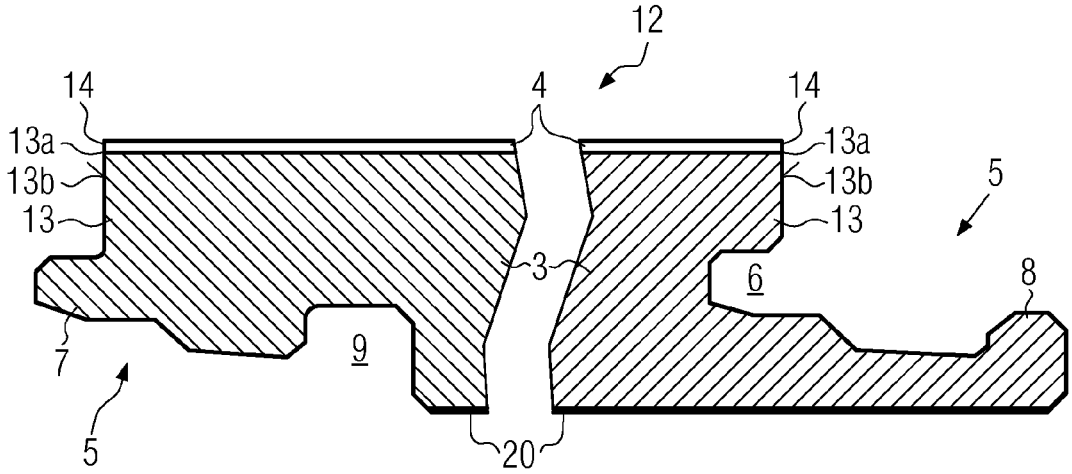
FIGS. 3, 4, 5 explain the method of the invention with reference to a schematic illustration of the results of different steps of the method.

As seen in FIG. 3, a panel body 12 is first of all provided for carrying out the method of the invention. The panel body 12 includes the core 3 which has been provided with the top surface layer 4 and the bottom layer 20 and already includes the joining elements 5 in the illustrated embodiment.

Above the joining elements 5 on both sides 2*a*, 2*b* of the panel 2, the core 3 of the panel body 12 includes a material web 13 which comprises a top side 13*a* which is flush with and extends in the same plane as the top side 3*a* of the core 3. The material web 13 further includes a side surface 13*b* which extends substantially in a direction transverse to and preferably at a right angle relative to the top side 13*a*. The top sides 3*a* and 13*a* are covered with the top surface layer 4 which extends up to the side surface 13*b* and forms an upper corner 14 therewith. In the illustrated embodiment the material web 13 is an integral part of core 3.

Figure 4:
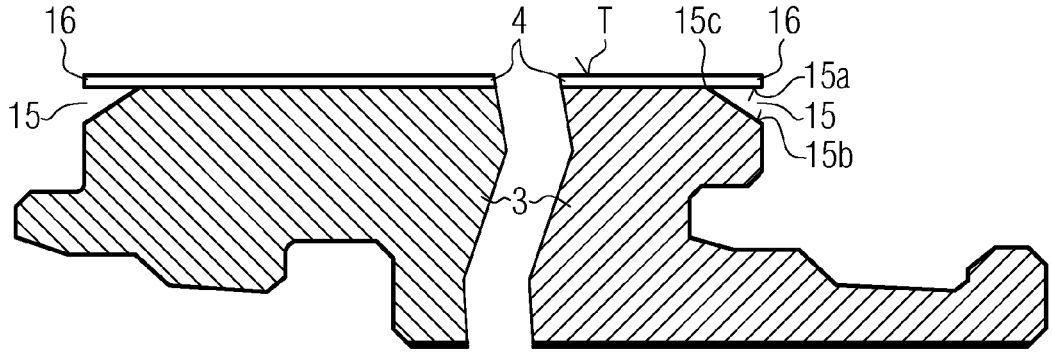

Subsequently, as shown in FIG. 4, a temporary recess 15 is formed from the side surface 13*b* into the material web 13 of the core 3. If the core 3 consists of a wood material, the recess 15 is preferably milled. The recess 15 extends below the surface layer 4 and substantially along the whole side 2*a*, 2*b* in a direction perpendicular to the plane of FIG. 4. The recess 15 is designed such that a freestanding ledge 16 is left including the tread surface T and at least a part of the top surface layer 4. The recess 15 has a first recess surface 15*a* and a second recess surface 15*b* which converge in the shape of a wedge or triangle in a joint edge 15*c*. The first and second recess surfaces 15*a*, 15*b* are preferably made straight. The first recess surface 15*a* is here laid such that it extends substantially in horizontal direction and preferably flush with the top side 3*a* of the core 3. However, it is also possible that the first recess surface 15*a* is either shifted into a top surface layer 4 of a corresponding thickness or is arranged at a distance underneath the top surface layer, which is particularly recommended when the top surface layer 4 is very thin. Furthermore, it is possible to make the first recess surface 15*a* extend at an angle relative to the top side 3*a*. Finally, the two recess surfaces 15*a*, 15*b* may also be curved as explained below.

The second recess surface 15*b* extends in the illustrated embodiment at an angle relative to the top side 3*a* of the core 3. The dimensions of the recess 15 depend on the desired dimensions of the notch 10 and are optionally matched with the bending properties of the material of the ledge 16. The maximum distance between the recess surfaces 15*a*, 15*b* (at the opening of the recess 15 near the surface 13*b*) is to be chosen in accordance with the intended depth of the notch 10 and the flexibility of the ledge 16, so that the distance can be chosen greater the deeper the notch 10 should be and the more flexible the ledge 16 is.

Figure 5:
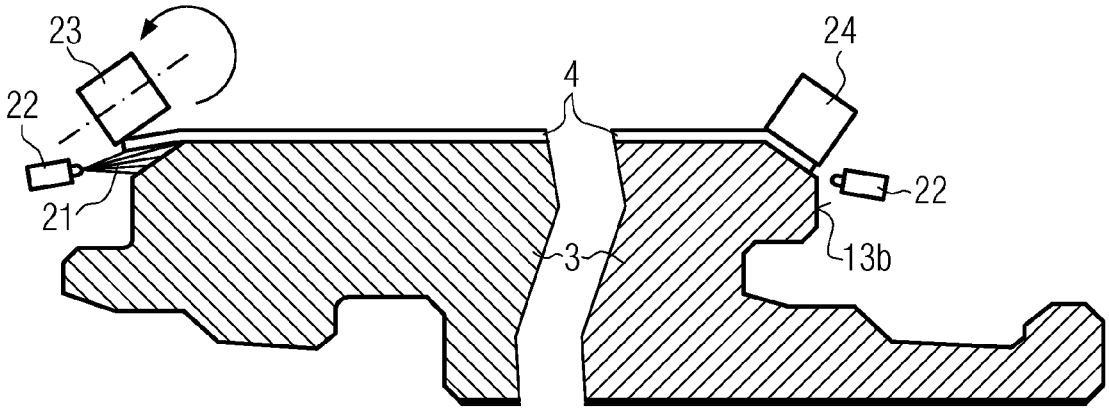

As shown in FIG. 5, left side, an adhesive 21 is then introduced into the recess 15 by means of an applicator 22 for closing the recess 15. Pressure is then exerted on the ledge 16, the pressure bending the ledge 16 inwards or downwards to such an extent that the two recess surfaces 15*a*, 15*b* are fixed to one another. This pressure can be applied by any tool means know in the art for that purpose; in FIG. 5, left side, a pressure roller 23, and in FIG. 5, right side, a linear pressure tool 24 is shown. Of course, one and the same or a plurality of similar tools can be used to press down all the ledges 16 on the panel 2.

Especially in cases where the two recess surfaces 15*a*, 15*b* between the side surfaces 13*b* and the joint edge 15*c* are of a different length, it is expedient to remove material from the side surface 13*b*, and preferably also from the free end of the ledge 16, until the two recess surfaces 15*a*, 15*b* have the same length and the free end of the ledge 16 after bending maintains it's vertical orientation. Since in the illustrated embodiment the recess surface 15*b* is longer than the recess surface 15*a*, material is removed from the side surface 13*b* underneath the recess 15 to such an extent that both recess surfaces 15*a* 15*b*, are of equal length, so that the step shown in FIG. 5, right side, which has been formed when the recess 15 is closed, is removed as shown in FIG. 2. A removal of the material may also be expedient to make sure that the upper corner 14 in the closed state of the recess 15 is the most projecting portion or one of the most projecting portions of the side surface 13*b*.

As a result, the upper corner 14 is reset below the upper tread surface T for forming the beveled edge 10*a*, 10*b*, with the top surface layer 4 extending continuously and in one piece up to and into the notch 10 when two panels 2' and 2" are attached to each other to form a floor covering 1. Furthermore, in the preferred embodiment of FIG. 1 the floor panel 2' abuts with its corner 14 on the corresponding corner 14 of the neighboring floor panel 2" to essentially completely cover the notch 10 with the top surfaces layer 4.

Figure 6:
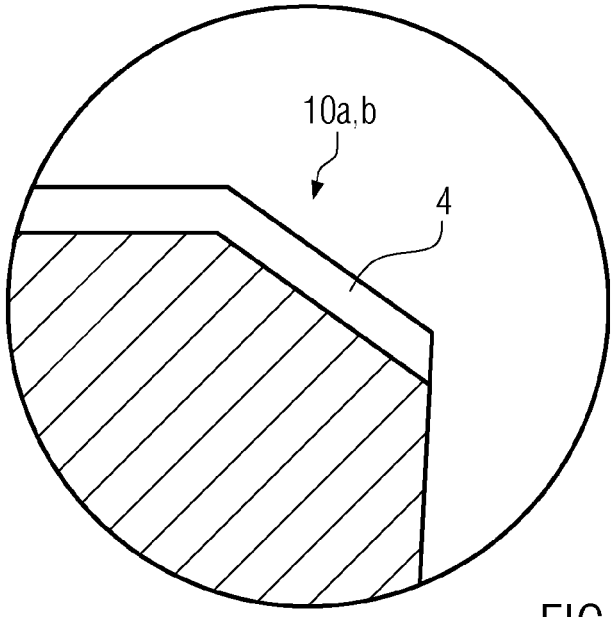
FIG. 6 is an enlarged illustration of an embodiment of a bevel.
Figure 7:
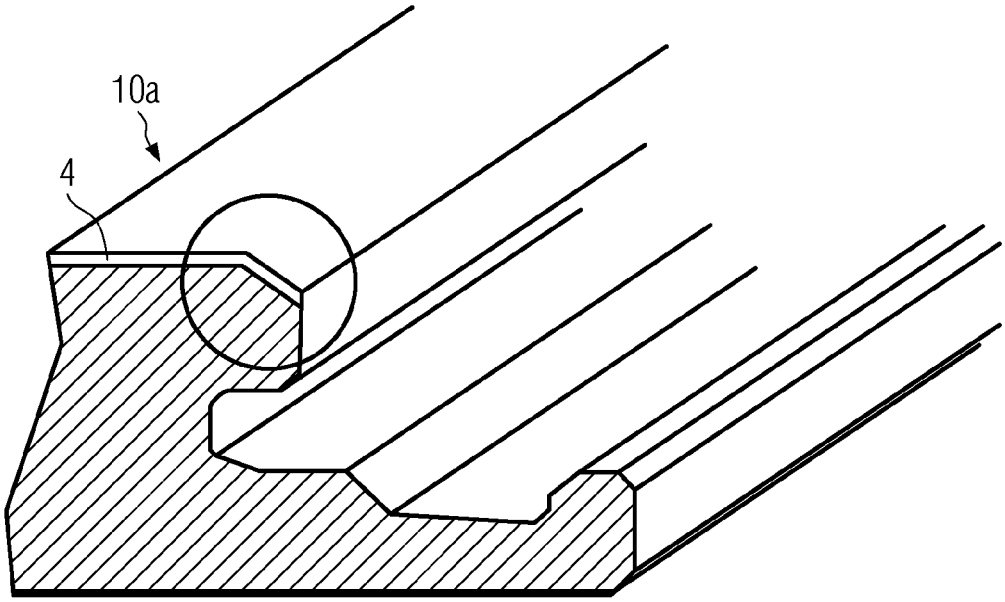
FIG. 7 is a perspective illustration of the bevel of FIG. 6.
Figure 8:
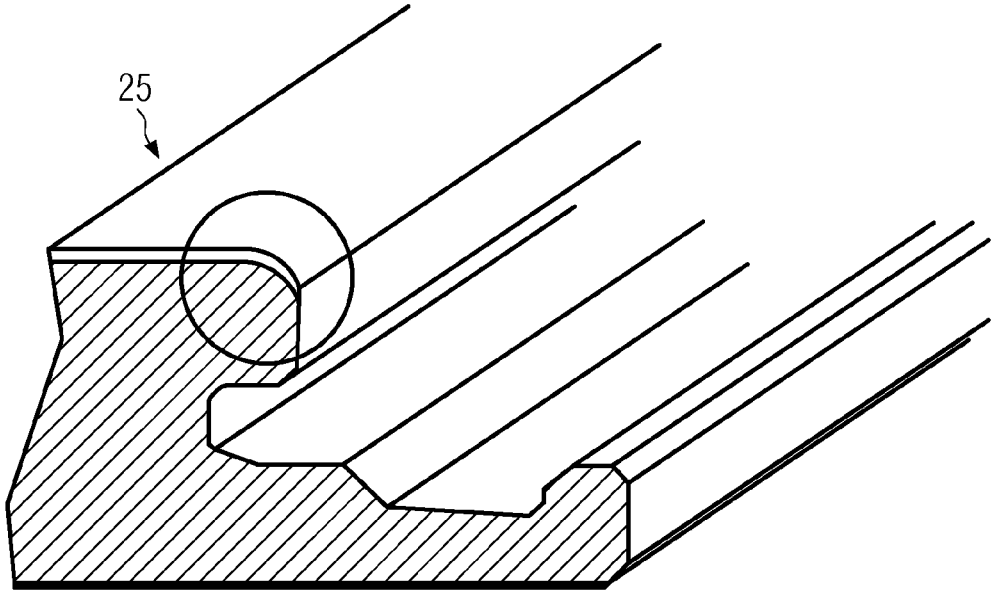
FIG. 8 is a further embodiment of a bevel.
Figure 9:
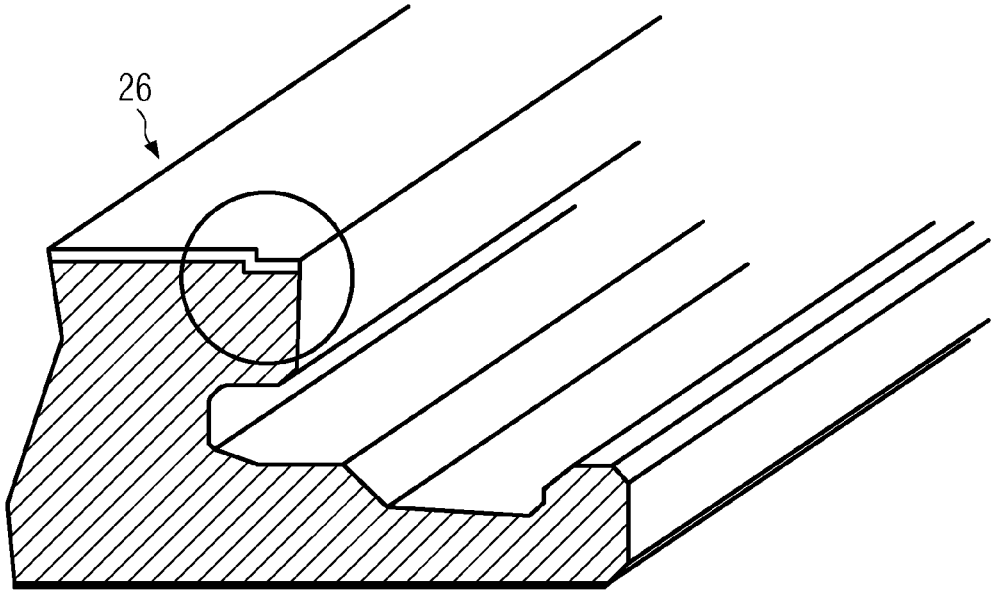
FIG. 9 is a further embodiment of a bevel.

FIGS. 6 to 9 show different shapes of beveled edges which can be formed by the method of the present invention. Especially, FIGS. 6 and 7 illustrate the preferred embodiment of a straight beveled edge 10*a*, 10*b* forming only one angle with the tread surface T and resulting in the wedge shaped notch 10 of FIG. 1. FIG. 8 illustrate a rounded beveled edge 25, and FIG. 9 illustrate a stepped beveled edge 26. The rounded and stepped beveled edges 25, 26 are to be manufactured by the method explained above, with a modified and adapted shaping of the recess surfaces of the temporary recess 15. When the temporary recess 15 is formed by leaving only a thin, bendable, ductile strip of material to form the ledge 16, i. a. essentially only the top layer 4 or a part thereof, than only the lower recess surface 15*b* has to be adapted to the desired shape of the beveled edge 25, 26, while the upper recess surface, i. a. the underside of the ledge 16, can remain straight. Otherwise, both recess surfaces have to be correspondingly shaped.

In a modification of the described and plotted embodiment, the invention may be employed in all forms and constructional designs of floor panels. The invention can particularly be used in floor panels that are e.g. provided with impact sound insulation. The invention can also be used for floor panels which are configured to be laid with the help of glue. Floor panels without molded-on joining elements which are fixed to one another with external joining elements may also be configured in accordance with the invention. The shape of the temporary recess for resetting the upper edge may be matched to the used material and the desired shape of the notch. Furthermore, it is possible to close or keep closed the temporary recess with the help of mechanical fixing elements or in a different way. The position of the recess may also be adapted to the constructional conditions, especially position, size and arrangement of the joining elements. The shape of the temporary recess may be changed further; for instance, it may be trapezoidal or formed with recess surfaces that upon closing of the recess are only fixed to one another over part of the recess. Although in the illustrated embodiment the joining elements were already produced before the formation of the temporary recess, it is possible, especially when wood material is used for the core, to produce the temporary recess together with the joining elements by way of a joint and correspondingly shaped milling tool.

I claim:

1. A floor panel comprising:

a panel body including a top side and a first and an opposite second side surface;

a top surface layer fixed to the top side of the body; and corresponding joining elements arranged on the first and the second side surfaces, respectively, for connecting to an adjacent floor panel to form a floor covering, wherein:

the joining elements further include an abutment surface on each of the first and second side surfaces, respectively, arranged adjacent and essentially perpendicular to the top side of the body for abutting to the adjacent floor panel of the floor covering; and wherein:

the body further includes a beveled top edge between each of the abutment surfaces and the top side, with the top surface layer extending continuously and in one piece from the top side of said body over the beveled top edges to a flushing arrangement with each of the abutment surfaces.

2. The floor panel of claim 1 wherein:

the beveled top edge is wedge-shaped.

3. The floor panel of claim 2 wherein:

the joining elements include a groove at the first side surface of the body and a projection on the second side surface of the body, the abutment surfaces extending from the beveled top edge to the groove and to the projection.

4. The floor panel of claim 1 wherein:

the joining elements include a groove at the first side surface of the body and a projection on the second side surface of the body, the abutment surfaces extending from the beveled top edge to the groove and to the projection.

5. A floor panel comprising:

a panel body including a top side and a first and an opposite second side surface;

a top surface layer fixed to the top side of the body; and corresponding joining elements arranged on the first and the second side surfaces, respectively, for connecting to an adjacent floor panel to form a floor covering, wherein:

the joining elements further include an abutment surface on each of the first and second side surfaces, respectively, arranged adjacent the top side of the body for abutting an adjacent floor panel of the floor covering; and wherein:

the body further includes a beveled top edge between each of the abutment surfaces and the top side, with the top surface layer extending continuously and in one piece from the top side of said body over the beveled top edges.

6. The floor panel of claim 5 wherein:

the beveled top edge is generally flat and disposed at an angle with respect to the top surface, such that a wedge-shaped recess is when the floor panel is joined to an adjacent similar panel.

7. The floor panel of claim 5 wherein:

the beveled top edge is curved.

8. The floor panel of claim 5 wherein:

the joining elements include a groove at the first side surface of the body and a projection on the second side surface of the body, the abutment surfaces on opposite sides of the panel extending from the beveled top edge to the groove and to the projection, respectively.

* * * * *